United States Patent [19]

Dietzel

[11] 4,131,482

[45] Dec. 26, 1978

[54] CONTINUOUSLY OPERATING SUGAR CENTRIFUGE

[75] Inventor: Walter Dietzel, Braunschweig, Fed. Rep. of Germany

[73] Assignee: Braunschweigische Maschinenbauanstalt, Braunschweig, Fed. Rep. of Germany

[21] Appl. No.: 790,613

[22] Filed: Apr. 25, 1977

[30] Foreign Application Priority Data

May 5, 1976 [DE] Fed. Rep. of Germany ... 7614228[U]

[51] Int. Cl.[2] ..... C13F 1/10

[52] U.S. Cl. ..... 127/19; 210/360 R; 210/380 R; 233/14 R; 233/47 R

[58] Field of Search ..... 127/19; 210/380 R

[56] References Cited

FOREIGN PATENT DOCUMENTS 1947485 6/1966 Fed. Rep. of Germany.
2364260 6/1975 Fed. Rep. of Germany.
1355763 2/1964 France.

*Primary Examiner*—Sidney Marantz
*Attorney, Agent, or Firm*—W. G. Fasse; W. W. Roberts

[57] ABSTRACT

A continuously operating sugar centrifuge has a centrifugal basket with three stages including a preseparating stage, an intermediate meshing-in and washing stage, and a separating stage proper. The intermediate stage has three zones, namely a first zone without any perforations or screens and with a cylindrical or somewhat inwardly inclined wall, adjacent to the preseparating stage, a second cylindrical or slightly outwardly inclined intermediate zone with a screening area in which the openings take up 2% maximum and a third zone having a wall with a 10° outward inclination at the most which merges into said separating stage and which carries a screen having the largest possible screen openings. A liquid supply device is arranged to feed liquid into the intermediate stage.

9 Claims, 3 Drawing Figures

CONTINUOUSLY OPERATING SUGAR CENTRIFUGE

BACKGROUND OF THE INVENTION

This invention relates to a continuously operating sugar centrifuge. A feeding and/or accelerating device continuously feeds the massecuite into the narrow bottom area of a frustum-shaped centrifugal basket which is provided on its inside with separating screen means. More specifically, the invention relates to an improved centrifugal basket for a continuously operating sugar centrifuge.

Continuously operating prior art sugar centrifuges are not capable of removing the molasses or syrup film adhering to the individual sugar crystals, as completely as is possible by the washing process in batch-type sugar centrifuges.

It has been a common practice for a long time to equip continuously operating sugar centrifuges with wash water nozzles as is illustrated in German Utility Model 1,947,485 and in French Patent 1,355,763. The purpose of the wash water nozzles is to imitate in continuously operating sugar centrifuges, the washing process carried out in batch-type sugar centrifuges. The wash water nozzles are arranged in the centrifugal basket in such a position that the wash water strikes the sugar crystal layer creeping along the surface of the separating screens, only when the liquid phase of the massecuite, namely the syrup or the molasses, has already been substantially separated so that it will be only necessary to remove the molasses or syrup film adhering directly to the sugar crystals surfaces by a washing process. However, in practice, these wash water nozzles have not made it possible to obtain a satisfactory result.

Other attempts to retain the layer of flowing sugar crystals or to impede their advance when feeding the wash liquid or to guide it over a step of the centrifugal basket have also failed to yield satisfactory results.

In the centrifuge constructed according to the above mentioned French Patent 1,355,763, for example, an intermediate cylindrical wall section is arranged in the curing basket and there is also a gradual increase in the diameter. Washing liquid is also supplied into the centrifuge. However, this intermediate cylindrical wall section is directly followed by a separating stage equipped with screens. Thus, the washing liquid is discharged immediately before a dilution process can become effective.

Similarly, German Patent Publication (DOS) 2,364,260, which is not constructed as a continuously operating sugar centrifuge, but rather as a washing centrifuge, fails to perform as does the instant invention. The conical centrifugal basket in said German DOS 2,364,260 is equipped with steps of unperforated wall sections which have only a very slight inclination. This known machine cannot be used as a sugar centrifuge because if the axis of the washing stages is long enough to achieve, in terms of time, the desired dilution, boundary friction of the sugar crystals on the solid wall occurs at the end of the washing stages, whereby the sugar quality is reduced. If on the other hand, the stages are short enough in the axial direction so that the boundary friction is avoided, the centrifuge would not provide a complete washing process. The washing process would be carried out only just long enough to start the reaction. The washing liquid again would be removed immediately before the sugar crystal coatings could be diluted and removed.

OBJECTS OF THE INVENTION

In view of the foregoing, it is the aim of the invention to achieve the following objects, singly or in combination:

to develop a continuously operating sugar centrifuge so that the washing of the sugar crystals may be carried out in such a way that its results are comparable to that of the washing process in a batch-type centrifuge;

to produce a continuously operating sugar centrifuge that efficiently removes the molasses or syrup film adhering to the sugar crystal surfaces;

to avoid discharging of the washing liquid prior to the time when the solution process may become effective; and to construct the entrance portion of a continuously operating centrifugal basket in such a manner that the sugar crystals will be slowed down for a sufficient length of time to provide an efficient syrup film removal.

SUMMARY OF THE INVENTION

This invention provides a superior, continuously operating sugar centrifuge wherein between the first and/or preseparating stage for the continuously supplied massecuite and a third separating stage there is arranged a second juicing-up and/or washing stage which has three zones. The lower or first zone has walls with a slightly negative conical inclination or, at most, straight cylindrical walls. If the walls of the first juicing-up or washing zone are cylindrical, they may be provided with stepped increases in diameter as compared to the largest diameter of the first, preseparating stage. The juicing-up or washing zone is followed by a second, intermediate zone with walls having a slight positive inclination in the direction of product throughput or, at most, straight cylindrical walls. The intermediate zone is provided with a separating screen having a maximum opening area of 2% of its total area. The purpose of the intermediate zone is to avoid boundary friction of the sugar crystals and to prevent a premature loss of the bulk of the juicing-up or washing liquid. The boundary friction is prevented by a constant liquid film between the intermediate zone screen and the sugar crystals.

The intermediate zone is followed by a third or separating zone with walls of a positive or outward maximum inclination of 10°. The separating zone comprises a separating screen with the largest possible opening area. It is in this zone that most of the washing liquid is discharged together with the molasses or syrup which used to coat the sugar crystals. The separating zone merges with its upper, largest diameter end into the conventional separating or third stage where the sugar crystals are treated in the usual manner. The second, juicing-up zone is provided with the means for supplying the juicing-up and/or washing liquid.

BRIEF FIGURE DESCRIPTION

In order that the invention may be clearly understood, it will now be described by way of example, with reference to the accompanying drawings, wherein.

DETAILED DESCRIPTION OF PREFERRED EXAMPLE EMBODIMENTS

Figure 1:
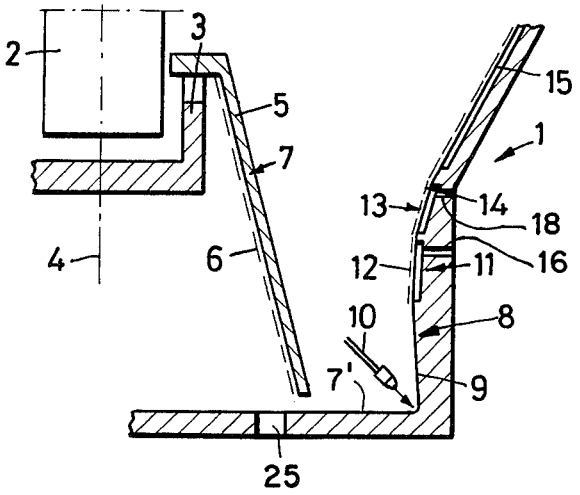
FIG. 1 is a partial, sectional view axially through the right hand half of a continuously operating sugar centrifuge basket according to the invention.

FIG. 1 shows the lower right hand portion of the centrifugal basket 1 of a continuously operating sugar centrifuge. An inlet pipe 2 continuously feeds massecuite into the centrifugal basket through an accelerator cup 3 secured to the top of the drive shaft shown schematically at 4. An acceleration bell 5 which opens radially outwardly from its top to its bottom, is positioned around the accelerator cup 3 to receive the massecuite from the cup 3. The massecuite flows over the upper edge of the cup 3. A separating screen 6 is provided inside of the acceleration bell 5 to form a preseparating stage 7. In the preseparating stage 7 the liquid portion of the massecuite, i.e., the molasses or the syrup is, to large extent, removed so that at the lower end of the preseparating stage 7 only sugar crystals coated with syrup or molasses are supplied into the next or second stage which is the multizoned intermediate stage 8 of the invention.

At the bottom of the centrifuge basket 1 the combination washing and/or juicing-up stage 8 is arranged between the stage 7 and a third stage 15 forming the separating stage proper. The combination washing and juicing-up stage 8 is supplied with washing liquid through fluid injecting means such as nozzle means 10. The combination juicing-up and washing stage 8 has three zones, a juicing-up zone 9, an intermediate zone 11, and a separation zone 13. The juicing-up zone 9 is provided with an impermeable and unperforated wall which may be cylindrical or which may have a slightly inward inclination. Holes 25 may be provided in the bottom 7' of the basket 1 for removal of the liquid phase of the massecuite.

The walls of the intermediate zone 11 are cylindrical or have a slight positive or radially outward inclination relative to the rotational axis of the basket 1. Further, the zone 11 has a screen 12 of a very small open screening area. The maximum open areas of the screen 12 is about 2%. The small screen openings provide limited liquid separating means. A void area back of the screen 12 is connected to the outside of the centrifugal basket by means of a channel 16.

A separating zone 13 is provided above the intermediate zone 11. The walls of the separating zone 13 are inclined outward in a positive direction to an inclination of a maximum of about 10°, whereby the top of the separating stage is further away from the rotational axis of the centrifuge than its bottom. The separating zone 13 is equipped with a screen 14 of maximum open screen area. A space between the screen 14 and the body of the basket 1 is connected through a passage 18 to the outside of the centrifuge.

Above the last separating zone 13 of the intermediate stage 8 there is located a third or reseparating stage 15 of a continuously operating sugar centrifuge. The top of the reseparating stage 15 flares outward from the center line 4 of the centrifuge at a positive inclination.

Figure 2:
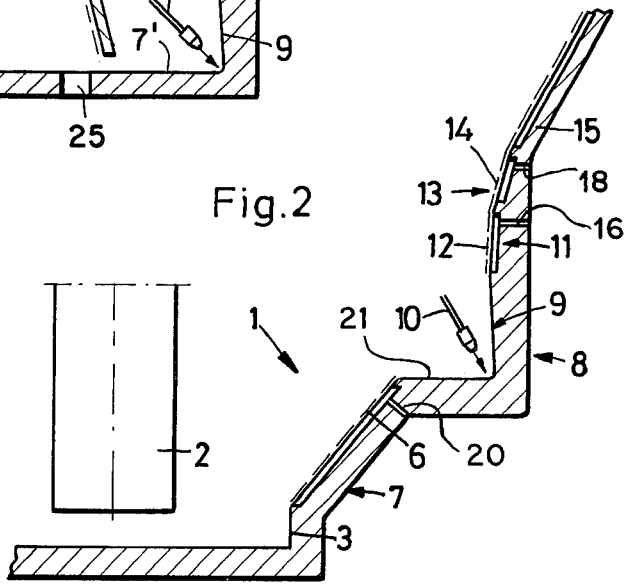
FIG. 2 is a partial, sectional view of an alternative embodiment of the invention.

FIG. 2 illustrates a second embodiment of the invention. In this embodiment an accelerator cup 3 forms part of the bottom of the centrifugal basket 1 underneath the usual inlet pipe 2. The preseparating stage 7 is located above the accelerator cup 3 in this embodiment. This arrangement corresponds to the preseparating stage 7 of FIG. 1 but it looks somewhat different. The preseparating stage 7 is provided with a screen 6. A space between the screen 6 and the wall of the basket is connected to a discharge channel 20.

A step 21 with an increased diameter connects the preseparating stage 7 to the stage 8. The combination juicing-up and washing stage 8 of FIG. 2 is provided with a first juicing-up zone as in FIG. 1. The wall of the zone 9 is cylindrical or slightly inwardly inclined. A wash nozzle 10 is arranged to supply the juicing-up liquid to the zone 9. The combination juicing-up and washing zone 9 of the stage 8 is followed by an intermediate zone 11, a separating zone 13, and a reseparating stage 15 as described with reference to FIG. 1.

Figure 3:
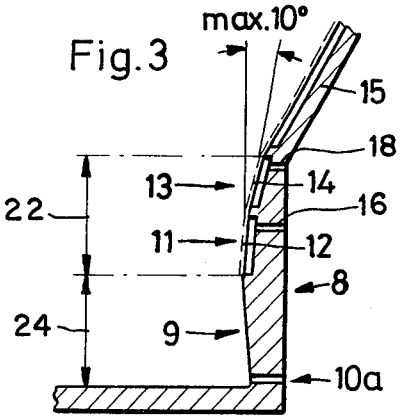
FIG. 3 is a partial, sectional view of a further embodiment of the intermediate zone of the invention with inlet means for supplying the washing liquid, and may be used in the embodiments of FIGS. 1 and 2.

FIG. 3 shows how the invention should be dimensioned and illustrates an alternative wash water supply method. Here again the juicing-up and washing stage 8 has the above mentioned three zones 9, 11, and 13. For simplicity, the inlet pipe, the accelerator cup, and the preseparating stage have been omitted.

The combination juicing-up and washing stage 8 is provided with a channel 10*a* through the wall of the centrifugal basket to supply wash liquid rather than using the nozzle 10 of FIG. 1 or 2.

The axial length of the wall of the washing and juicing-up zone 9 of stage 8 is indicated by an arrow 24. The combined axial length of the intermediate zone 11 and the separating zone 13 is indicated by an arrow 22. It has been found that optimum results are obtained when the axial length 24 of the zone 9 is as long or longer than the combined axial lengths 22 of the intermediate zone 11 and the separating zone 13. FIG. 3 also shows that the inclination of the separating zone 13 should be a maximum positive inclination of 10°.

The present centrifugal basket operates as follows. The massecuite is continuously fed downwardly through the inlet pipe 2 into the rotating acceleration cup 3. The massecuite flows over the upper edge of the cup 3 and thus into contact with the acceleration bell 5 of the preseparating stage 7. During the travel along the bell 5 the molasses or syrup is removed to a large extent from the moving sugar crystals. In FIG. 2, for example, the liquid portion of the massecuite leaves the preseparating stage through a port 20 in the wall of the centrifugal basket 1. At the end of the preseparating stage 7 only sugar crystals, with a molasses or syrup coating still adhering tightly thereto, are fed upwardly into the intermediate or juicing-up and washing stage 8.

The present invention achieves the above objects because after the separation of the liquid phase of the massecuite from the sugar crystals in the preseparating stage 7, there follows a stepped increased of the diameter in an area 7' or 21 connecting the preseparating stage 7 and the juicing-up zone 9 of the juicing-up and/or washing stage 8. The sugar crystals pass through this area 7' or 21 without any initial continuous acceleration. In the impermeable unperforated area, namely in the juicing-up zone 9, it is thus necessary to bring about an acceleration of the sugar crystals to the circumferential velocity prevailing in this zone 9. Such acceleration takes place since the juicing-up and/or washing liquid is fed into the impermeable, unperforated juicing-up zone 9 and because of an internal slippage in the liquid crystal mixture, the acceleration causes an agitating and a mixing process in which the liquid and the crystals are brought into intimate contact with each other and are also moved relative to each other. This action is important since it has been found that this type of action removes from the sugar crystals the very thin skins of molasses or syrup films adhering to the crystal surfaces, in spite of the high viscosity and in spite of the high adhesive strength of these skins or films. Such removal of the skins are films from the crystal surfaces transfers the molasses or syrup into the juicing-up and/or washing liquid where the molasses or syrup is diluted. At the very least such action starts the solution and hence also the dilution.

After this treatment of the sugar crystals in the juicing-up zone 9 which induces the reaction, the solution process is being continued even when the sugar crystals are not any longer intensively moved relative to each other due to the the completion of the acceleration process, and when the crystals have assumed the circumferential velocity which prevails in this zone 9. As a result of the prevailing centrifugal force corresponding to the circumferential velocity, a sedimentation could now take place, whereby the sugar crystals would be situated radially outwardly and the juicing-up and/or washing liquid would be located radially inwardly. The sugar crystals then would produce a boundary friction at the wall whereby they would be dulled. To avoid this boundary friction and dulling, the juicing-up zone is followed by the intermediate zone 11 which is equipped with a screen of a very small open screening area, for example, 2% as mentioned above, whereby due to the prevailing centrifugal force, small liquid quantities may pass through this screen. As a result, there is always a liquid film between the screen surface and the sugar crystals. This liquid film acts as a sliding film and prevents a dry boundary friction of the sugar crystals. However, a separation or removal of larger liquid quantities is prevented, whereby the continuation of the solution and dilution processes within the intermediate zone 11, following the inducing reaction, is assured.

In the following separating zone 13 of the juicing-up and/or washing stage 8, there is provided a separating screen 14 with a maximum open screening area for discharging the juicing-up and/or washing liquid, supplied to the entrance of this stage together with the molasses and/or syrup films removed from the sugar crystals or, rather their surfaces. The sugar crystals which have almost completely been freed of syrup or molasses residues enter the reseparating stage 15 of the centrifugal basket where they are treated in the usual manner.

Although the invention has been described with reference to specific example embodiments, it is to be understood that it is intended to cover all modifications and equivalents within the scope of the appended claims.

What is claimed is:

1. In a basket structure for a continuously operating sugar centrifuge into which massecuite is continuously supplied by feeding and accelerating means including a preseparating stage and a further separating stage, the improvement comprising washing stage means arranged between said preseparating stage and said further separating stage, said washing stage means comprising three zones including a juicing-up zone, an intermediate zone and a separating zone, arranged in that order as viewed in the flow-direction of the material being centrifuged, said juicing-up zone having impermeable and unperforated wall means with a radial spacing from said preseparating stage, said intermediate zone comprising first separating screen means with an open screening area of maximal 2% of its total area, said separating zone comprising wall means having a radially outward inclination of up to 10° relative to the vertical, whereby the separating zone has an outwardly flaring upper end, said separating zone further comprising second screen means having a maximum of open area relative to its total area, said upper end of said separating zone merging into said further separating stage, and washing liquid supply means operatively arranged for feeding washing liquid into said juicing-up zone.

2. The basket structure of claim 1, wherein said impermeable and unperforated wall means of said juicing-up zone are radially inwardly inclined or cylindrical.

3. The basket structure of claim 1, wherein said radial spacing of said impermeable and unperforated wall means of the juicing-up zone provides the juicing-up zone with a diameter larger than the largest diameter or the end diameter of said preseparating stage.

4. The basket structure of claim 1, wherein said intermediate zone comprises wall means having a radially outward inclination in the direction of material travel or which are cylindrical.

5. The basket structure of claim 1, including an acceleration basket proper, wherein said preseparating stage is arranged as part of said accelerating means including an acceleration bell having on its inside a separating screen, said acceleration bell flaring radially outwardly and downwardly into an area adjacent to the bottom of said acceleration basket proper, said accelerating means further including drive shaft means and an acceleration cup secured to the upper end of said drive shaft which reaches into said acceleration basket proper.

6. The basket structure of claim 1, wherein said preseparating stage, said washing stage means, and said further separating stage are arranged in series relative to each other in that order and relative to the axial direction.

7. The basket structure of claim 1, wherein said liquid supply means comprises a passageway through the wall means of said juicing-up zone.

8. The basket structure of claim 1, wherein said liquid supply means comprise nozzle means arranged to spray liquid against the impermeable and unperforated wall means of the juicing-up zone.

9. The basket structure of claim 1, wherein said juicing-up zone has an axial length corresponding to or exceeding the combined axial length of said intermediate zone and of said separating zone.

* * * * *